US007404224B2

(12) United States Patent
Durrant

(10) Patent No.: US 7,404,224 B2
(45) Date of Patent: Jul. 29, 2008

(54) METHOD FOR REMOVING STAINS FROM TEXTILES

(76) Inventor: Edward E. Durrant, P.O. Box 465, Paradise, UT (US) 84328

( * ) Notice: Subject to any disclaimer, the term of this patent is extended or adjusted under 35 U.S.C. 154(b) by 0 days.

(21) Appl. No.: 11/779,355

(22) Filed: Jul. 18, 2007

(65) Prior Publication Data

US 2008/0011326 A1 Jan. 17, 2008

Related U.S. Application Data

(62) Division of application No. 10/937,583, filed on Sep. 8, 2004, now Pat. No. 7,271,140.

(51) Int. Cl.
*D06B 1/02* (2006.01)

(52) U.S. Cl. ..... 8/148; 510/276

(58) Field of Classification Search ..... 8/148; 68/200; 15/321; 510/276
See application file for complete search history.

(56) References Cited

U.S. PATENT DOCUMENTS

| | | | | |
|---|---|---|---|---|
| 3,709,825 | A | | 1/1973 | Chirash et al. |
| 4,120,180 | A | * | 10/1978 | Jedora ..... 68/20 |
| 4,124,542 | A | | 11/1978 | Devine |
| 4,148,603 | A | * | 4/1979 | Schwuger et al. ..... 8/137 |
| 4,926,514 | A | * | 5/1990 | Leuenberger ..... 8/150 |
| 5,011,621 | A | | 4/1991 | Sullivan |
| 5,064,557 | A | | 11/1991 | Fusiak |
| 5,098,591 | A | | 3/1992 | Stevens |
| 5,253,378 | A | * | 10/1993 | Jung, Jr. ..... 8/149.1 |
| 5,259,848 | A | | 11/1993 | Terry et al. |
| 5,334,331 | A | | 8/1994 | Fusiak |
| 5,340,493 | A | | 8/1994 | Principato |
| 5,346,640 | A | | 9/1994 | Leys |
| 5,424,001 | A | | 6/1995 | Bayless |
| 5,437,808 | A | | 8/1995 | Weltman et al. |
| 5,464,555 | A | | 11/1995 | Bayless |
| 5,561,215 | A | | 10/1996 | Pourreau |
| 5,665,690 | A | | 9/1997 | Lucas et al. |
| 5,772,788 | A | | 6/1998 | Ikeda et al. |
| 5,786,317 | A | | 7/1998 | Townsend |
| 5,861,364 | A | | 1/1999 | Beers et al. |
| 5,891,198 | A | * | 4/1999 | Pearlstein ..... 8/158 |
| 5,905,065 | A | | 5/1999 | Scialla et al. |
| 5,955,410 | A | | 9/1999 | Dingess et al. |
| 6,028,044 | A | | 2/2000 | Harris |
| 6,265,363 | B1 | | 7/2001 | Viscovitz |
| 6,326,344 | B1 | | 12/2001 | Levitt |
| 6,566,316 | B2 | | 5/2003 | Hiatt et al. |
| 6,589,294 | B2 | | 7/2003 | Hortel et al. |
| 6,706,676 | B2 | | 3/2004 | Swensen |
| 2002/0013237 | A1 | | 1/2002 | Viscovitz et al. |
| 2002/0189036 | A1 | | 12/2002 | Thomas |
| 2003/0032570 | A1 | | 2/2003 | Hiatt et al. |
| 2003/0216268 | A1 | | 11/2003 | Swensen |
| 2005/0119142 | A1 | | 6/2005 | Oh et al. |

* cited by examiner

*Primary Examiner*—Frankie L Stinson
(74) *Attorney, Agent, or Firm*—Advantia Law Group; Michael W. Starkweather; Jason P. Webb

(57) ABSTRACT

A stain removing composition having a mixture of N-methyl pyrrolidinone and at least one solvent from the group consisting of 3-pentanol, dipropylene glycol monomethyl ether, propylene glycol n-propyl ether, and diethylene glycol monobutyl ether. Preferably the stain removing composition comprises, in percent by weight about 70-90%, N-methyl pyrrolidinone and about 10-30%, in percent by weight, at least one of the solvents from the group described above. In another embodiment, a method of removing a stain from a textile includes the steps of applying the stain removing composition to an area of application. After the composition has been applied to the area of application it is removed with a suction device or other type of absorption device. Water may be applied to the area of application after the composition has been applied to dilute the composition and help in the removal process.

16 Claims, No Drawings

METHOD FOR REMOVING STAINS FROM TEXTILES

CROSS-REFERENCE TO RELATED APPLICATIONS

This application is a Divisional Application of, under 35 U.S.C. § 121, and claims priority to, under 35 U.S.C. § 121, U.S. Non-Provisional application Ser. No. 10/937,583, entitled COMPOSITION FOR REMOVING STAINS FROM TEXTILES by Edward E. Durrant, filed on 8 Sep. 2004.

BACKGROUND OF THE INVENTION

1. Field of the Invention

This invention relates to a composition for removing stains on textiles. More particularly this invention relates to a composition of n-methylpyrrolidone and another co-solvent to effectively and safely remove ink from carpets.

2. Description of the Related Art

Inks, lipstick, lacquer based polishes and/or paints ("residues") have historically been a bane to the existence of carpet owners. This is primarily due to the fact that these products, such as fingernail polish, contain resins that form hard residues when allowed to dry. When left to dry on a textile, such as carpet, the extraction of these resins can be extremely difficult and potentially damaging to the textile itself.

A handful of organic compounds have been identified which have been successfully used as broad spectrum solvents in removing the residues. Unfortunately, the great majority of these have ultimately been found to present undesirable toxicologies and serious hazards to the environment; examples of these compounds include methylene chloride and methyl ethyl ketone (MEK), as well as toluene, xylene, and other aromatics, many of which include the additional hazard of high flammability. For example, although MEK has long been considered a satisfactory solvent from the standpoint of cleaning effectiveness, there is a growing concern that the toxicity and flammability of MEK exposes users to unnecessary risks. Also, because used MEK is considered a threat to the environment, and so is classified as a hazardous waste, the expense associated with the safe disposal of MEK is on the order of 5-10 times greater than the amount which the user initially pays for the solvent. Moreover, because of its relatively high vapor pressure, the loss of MEK to the atmosphere during use is excessive, necessitating the use of large and expensive collection systems such as vacuum hoods.

Because of the concern for the safety, health, and environmental hazards which these known organic solvents thus present, both the federal and state governments are promulgating increasingly stringent criteria which solvent users must comply with. For instance, the California State Legislature limits the use of volatile solvents by requiring that they have a vapor pressure below about 45 mmHg at twenty degrees Celsius. In addition, regulations require that solvents be disposed of in a manner that will not adversely affect the environment. For many users of such solvents, this disposal generally translates into increased operating costs, as noted above.

For the above reasons, a primary consideration for many users of organic solvents has become the toxicity of a particular solvent mixture, and also the hazards which it presents to the environment. This has lead to a number of attempts to find safe substitutes for the hazardous organic solvents which have been used in the past. As an example, methylene chloride has been widely used in industry, especially for formulating paint strippers, lacquer removers, and paint clean-up systems, but it suffers from high volatility which leads to excessive evaporation, contributing to worker exposure and environmental pollution.

Attempts have consequently been made to replace methylene chloride using various, safer organic solvents, but for the most part the replacement solvents create additional problems. Many of the solvents suitable for dissolving oil-based compounds are volatile. These solvents tend to evaporate before they have had sufficient contact time with the affected area and the dissolution process fails. Furthermore, many of these volatile solvents are flammable, which makes suction of the solvent into non-spark proof wet vacuums dangerous. As a result, methods utilizing volatile solvents typically involve blotting or rubbing the treated area, which are much less effective and much more labor intensive than suction techniques.

For example, n-methylpyrrolidone (NMP) has sometimes been found to be a suitable substitute for MEK or methylene chloride in terms of its solvent abilities and it exhibits a very low volatility, which drastically reduces the flammability hazard and evaporative losses. However, NMP alone is sometimes excessively harsh for many applications in that it may cause damage to the underlying substrate. Other compositions of n-methylpyrrolidone include a plant or animal-derived oil as an essential component.

Under the typical and well-known polish extraction techniques, NMP is poured over the affected area in order to dissolve and soften the residue. A commonly recognized aspect of this process is to ensure that the NMP remains in continuous contact with the residue in order to fully dissolve the same. However, prolonged contact of the NMP with the textile may cause a latex adhesive or similar fabric backing to delaminate. This is a common problem resulting from applying such solvents to carpets because typical latex adhesives that bind carpet fibers to the carpet backing material can be degraded relatively quickly by overexposure to the solvent. Too little NMP is not effective at removing stains.

Thus, it can be clearly recognized that there is a need for composition for safely removing stains from textiles, such as carpet, that does not damage the affected textile, and a method for accomplishing the same.

SUMMARY OF THE INVENTION

The various elements of the present invention have been developed in response to the present state of the art, and in particular, in response to the problems and needs in the art that have not yet been fully solved by currently available cleaning compositions. Accordingly, the present invention provides an improved cleaning composition.

More particularly, one embodiment relates to a stain removing composition comprising N-methyl pyrrolidinone and at least one solvent from the group consisting of 1-methyl-2-butanol (also known as 3-pentanol), dipropylene glycol monomethyl ether, propylene glycol n-propyl ether, and diethylene glycol inonobutyl ether. Preferably the stain removing composition comprises, in percent by weight about 70-90%, N-methyl pyrrolidinone and about 10-30%, in percent by weight, at least one of the solvents from the group described above.

Another embodiment of the present invention relates to a method of removing a stain from a textile comprising the steps of applying to an area of application of the textile a composition being prepared by admixing N-methyl pyrrolidinone and at least one of the group consisting of 1-methyl-2-butanol, dipropylene glycol monomethyl ether, propylene glycol n-propyl ether, and diethylene glycol monobutyl ether. Preferably, the stain removing composition comprises, in percent by weight about 70-90%, N-methyl pyrrolidinone and about 10-30%, in percent by weight, at least one of the solvents from the group described above. After the composition has been applied to the area of application it is removed with a suction device or other type of absorption device. Water may be applied to the area of application after the composition has been applied to dilute the composition and help in the removal process.

Additional features and advantages of the present invention will become more fully apparent from the following description and appended claims, or may be learned by the practice of the invention as set forth hereinafter.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In a first embodiment, a stain removing composition comprises N-methyl pyrrolidinone and at least one solvent from the group consisting of 1-methyl-2-butanol (also known as 3-pentanol), dipropylene glycol monomethyl ether, propylene glycol n-propyl ether, and diethylene glycol monobutyl ether. Preferably the stain removing composition comprises, in percent by weight about 70-90%, N-methyl pyrrolidinone and about 10-30%, in percent by weight, at least one of the solvents from the group described above.

The two, or more, components, N-methyl pyrrolidinone and 1-methyl-2-butanol, dipropylene glycol monomethyl ether, propylene glycol n-propyl ether, and diethylene glycol monobutyl ether, are mixed together in a container and applied to the area of application. Preferably, the composition is mixed in a spray container, but may be mixed in any kind of dispensing device. An important part of the application process is to prevent the solvent from dwelling on the textile for lengthy periods of time. To prevent the composition from migrating to the backing of the carpet and dissolve a latex in the primary and secondary carpet backing, the composition should be quickly removed from the textile, preferably using a suction device, such as a vacuum device.

Advantageously, the properties of the composition include low flammability (high flashpoints), water solubility or miscibility, and an effective ink or oil based spot removing capability. It is noted that the present invention comprises no amount of animal or plant oils. It is advantageous to exclude animal or plant oils because these oils are typically water insoluble. After cleaning an ink stain, water is used to remove any residual solvents. A plant or animal oil would most likely remain in the carpet after the rinsing step and attract soil.

The stain remover compositions listed in Tables 1 and 2 were prepared by combining N-methyl pyrrolidinone and at least one cosolvent, and mixing until a homogenous blend was obtained. These blends (Blend Numbers 1-8) illustrate various compositions within the scope of the invention. One skilled in the art will recognize, however, that many other blends may be used.

TABLE 1

STAIN REMOVER COMPOSITIONS (in percents by weight)

| | BLEND NUMBER | | | | | | | |
|---|---|---|---|---|---|---|---|---|
| Chemical Component | 1 | 2 | 3 | 4 | 5 | 6 | 7 | 8 |
| N-methyl pryrrolidinone | 90 | 90 | 90 | 85 | 85 | 85 | 80 | 80 |
| 1-methyl-2-butanol | 5 | — | — | — | 10 | — | 10 | — |
| dipropylene glycol monomethyl | 5 | 10 | — | — | 5 | 5 | — | — |
| ether propylene glycol n-propyl ether | — | — | 5 | 15 | 3 | 5 | 5 | 10 |
| diethylene glycol monobutyl ether | — | — | 5 | — | 2 | 5 | 5 | 10 |

TABLE 2

STAIN REMOVER COMPOSITIONS (in percents by weight)

| | BLEND NUMBER | | | | | | | |
|---|---|---|---|---|---|---|---|---|
| Chemical Component | 1 | 2 | 3 | 4 | 5 | 6 | 7 | 8 |
| N-methyl pryrrolidinone | 80 | 75 | 75 | 75 | 70 | 70 | 70 | 70 |
| 1-methyl-2-butanol | 2 | 5 | 10 | 10 | 30 | 10 | 15 | 10 |
| dipropylene glycol monomethyl | 3 | 5 | — | 10 | — | 10 | 5 | — |
| ether propylene glycol n-propyl ether | 10 | 5 | 10 | 5 | — | — | 5 | 10 |
| diethylene glycol monobutyl ether | 5 | 10 | 5 | — | — | 10 | 5 | 10 |

Another embodiment of the present invention relates to a method of removing a stain from a textile comprising the steps of applying to an area of application of the textile a composition being prepared by admixing N-methyl pyrrolidinone and at least one of the group consisting of 1-methyl-2-butanol, dipropylene glycol monomethyl ether, propylene glycol n-propyl ether, and diethylene glycol monobutyl ether. Preferably, the stain removing composition comprises, in percent by weight about 70-90%, N-methyl pyrrolidinone and about 10-30%, in percent by weight, at least one of the solvents from the group described above.

After the composition has been applied to the area of application it is removed with a suction device or other type of absorption device. The process may be repeated numerous times until the stain has been removed. Ultimately, water may be applied to the area of application after the composition has been applied to dilute the composition and help in the removal process.

It is understood that the above-described arrangements are only illustrative of the application of the principles of the present invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A method of removing a stain from a textile comprising the steps of:

applying to an area of application of the textile a composition being prepared by admixing:

about 70-90%, in percent by weight, N-methyl pyrrolidinone; and about 10-30%, in percent by weight, at least one solvent selected from the group consisting of 3-pentanol, dipropylene glycol monomethyl ether, propylene glycol n-propyl ether, and diethylene glycol monobutyl ether.

2. The method according to claim 1, further comprising the step of removing the composition from the surface of the textile.

3. The method according to claim 2, wherein the composition are removed with a suction device.

4. The method according to claim 3, wherein the suction device is a vacuum.

5. The method according to claim 2, wherein the composition is removed with an absorption device.

6. The method according to claim 1, further comprising the steps of:

applying water to the area of application to dilute the composition; and removing the water and the stain from the area of application.

7. The method according to claim 6, wherein the water and the composition are removed with a suction device.

8. The method according to claim 6, wherein the water and the composition are removed with an absorption device.

9. A method of removing a stain from a textile comprising the steps of:

applying to an area of application of the textile a composition being prepared by admixing:

about 70-90%, in percent by weight, N-methyl pyrrolidinone; and about 10-30%, in percent by weight, at least one solvent selected from the group consisting of dipropylene glycol monomethyl ether, propylene glycol n-propyl ether, and diethylene glycol monobutyl ether.

10. The method according to claim 9, farther comprising the step of removing the composition from the surface of the textile.

11. The method according to claim 10, wherein the composition are removed with a suction device.

12. The method according to claim 11, wherein the suction device is a vacuum.

13. The method according to claim 10, wherein the composition is removed with an absorption device.

14. The method according to claim 9, further comprising the steps of:

applying water to the area of application to dilute the composition; and removing the water and the stain from the area of application.

15. The method according to claim 14, wherein the water and the composition are removed with a suction device.

16. The method according to claim 14, wherein the water and the composition are removed with an absorption device.

* * * * *